US006764294B2

(12) United States Patent
Saddler

(10) Patent No.: US 6,764,294 B2
(45) Date of Patent: Jul. 20, 2004

(54) VIBRATORY MOLD SYSTEM FOR CONCRETE PRODUCTS

(75) Inventor: Samuel L. Saddler, Alpena, MI (US)

(73) Assignee: Besser Company, Alpena, MI (US)

( * ) Notice: Subject to any disclaimer, the term of this patent is extended or adjusted under 35 U.S.C. 154(b) by 239 days.

(21) Appl. No.: 10/148,429

(22) PCT Filed: Feb. 14, 2001

(86) PCT No.: PCT/US01/04759

§ 371 (c)(1),
(2), (4) Date: May 29, 2002

(87) PCT Pub. No.: WO01/66325

PCT Pub. Date: Sep. 13, 2001

(65) Prior Publication Data

US 2002/0180086 A1 Dec. 5, 2002

Related U.S. Application Data

(60) Provisional application No. 60/185,992, filed on Mar. 1, 2000.

(51) Int. Cl.[7] ..... B28B 1/087

(52) U.S. Cl. ..... 425/253; 425/432; 425/452; 425/456; 29/428; 264/71

(58) Field of Search ..... 425/211, 253, 425/424, 432, 452, 456; 264/71; 29/428

(56) References Cited

U.S. PATENT DOCUMENTS

| | | | |
|---|---|---|---|
| 3,545,053 | A | 12/1970 | Besser |
| 4,235,580 | A | 11/1980 | Springs et al. |
| 4,238,177 | A | 12/1980 | Crile et al. |
| 4,395,213 | A | 7/1983 | Springs et al. |
| 4,941,813 | A | 7/1990 | Grubb, Jr. et al. |
| 5,540,869 | A | 7/1996 | Aaseth et al. |
| 5,952,015 | A | 9/1999 | DeWyre et al. |

*Primary Examiner*—James P. Mackey
*Assistant Examiner*—Donald Heckenberg
(74) *Attorney, Agent, or Firm*—Reising, Ethington, Barnes, Kisselle Learman, P.C.

(57) ABSTRACT

A concrete product molding machine supports a mold with a vertically extending mold cavity. A pallet support is mounted for lifting movement to dispose a pallet to close the cavity. Attachment structure extends from the mold to rest on frame surfaces prior to being moved upwardly to provide a clearance for vertical vibration of the mold. Mechanism vibrates the mold in a vertical path having lateral x and y axis vibration components. A guidance pin receiver is carried by the support attachment structure and a pin carrier assembly on the machine frame carries a vertically reciprocal guidance pin movable from a remote position up into the pin receiver. A vibration limiter is disposed laterally to the pin for limiting at least one of the lateral vibration components and a motor operated mechanism is coupled to the pin for moving the pin vertically.

20 Claims, 12 Drawing Sheets

FIG-8
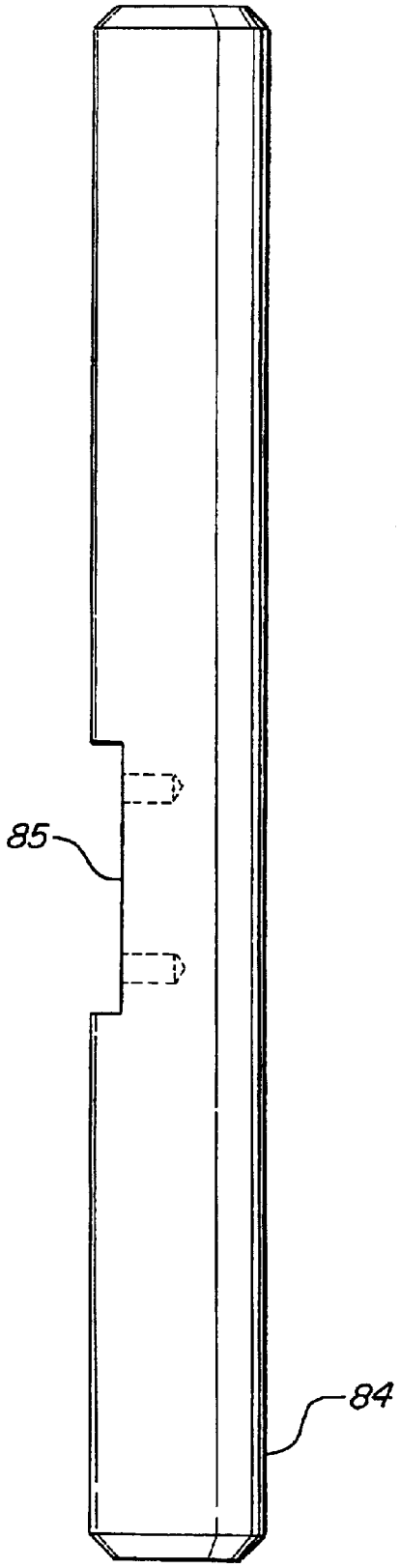
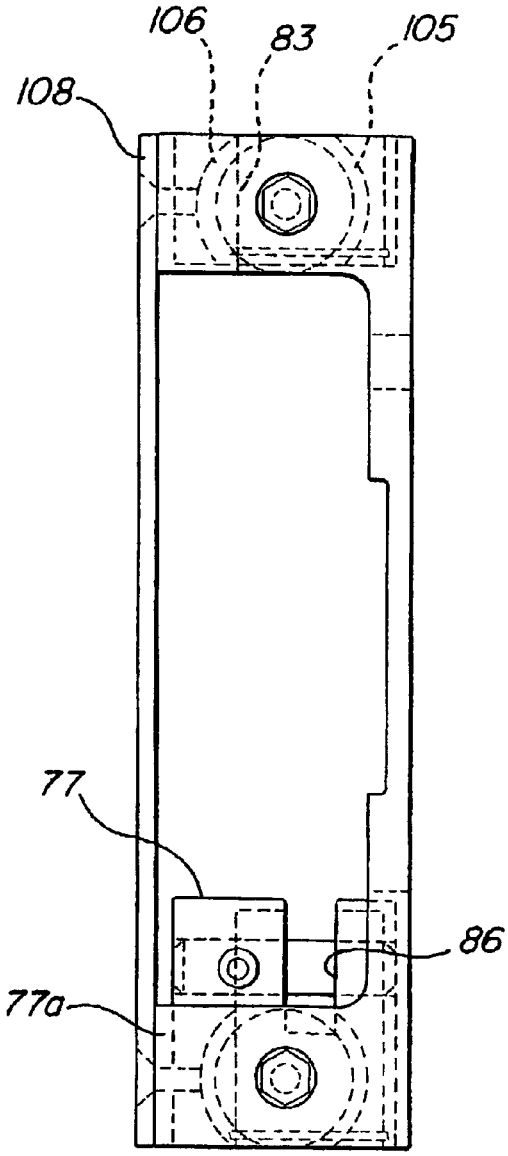
FIG-12

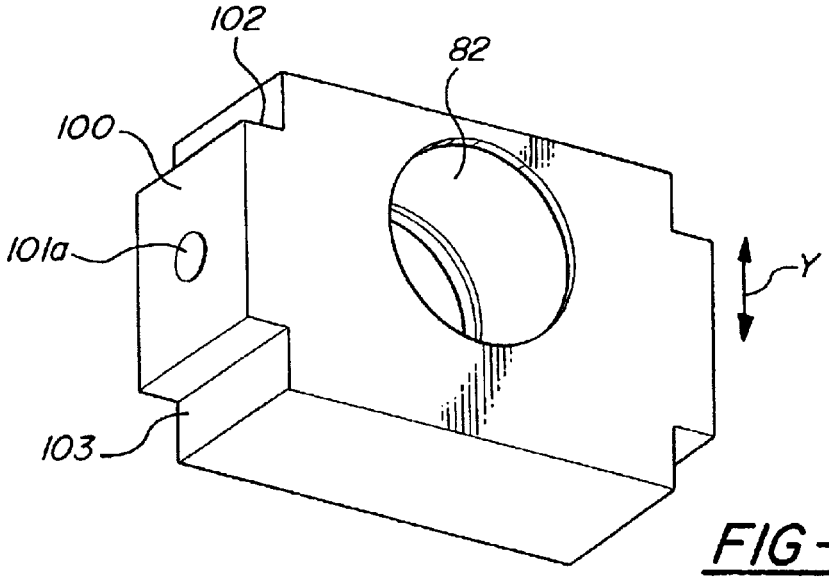
FIG-13
FIG-14
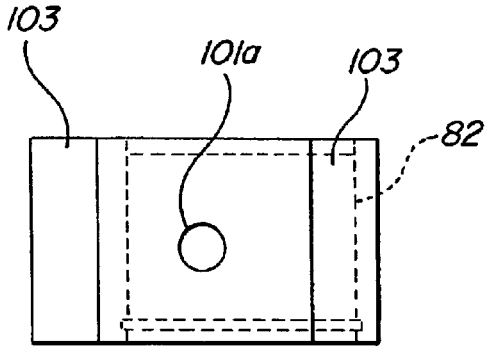
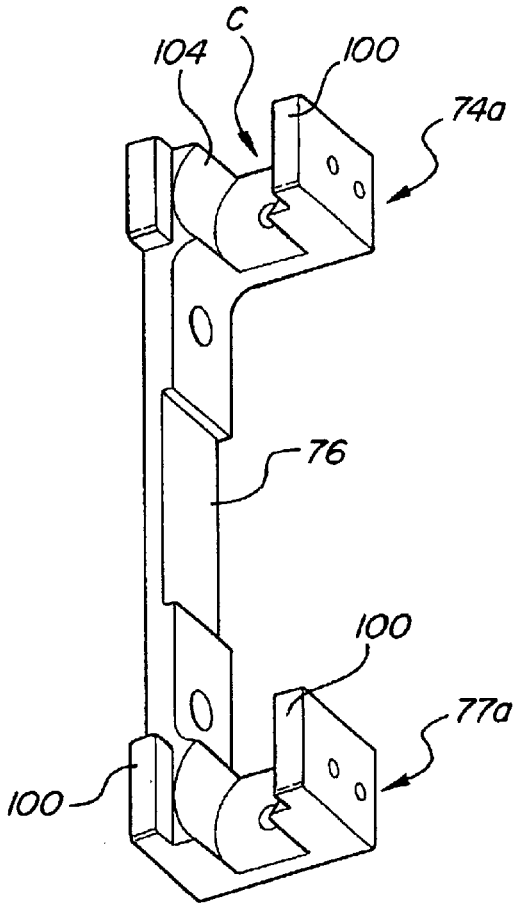
FIG-15

VIBRATORY MOLD SYSTEM FOR CONCRETE PRODUCTS

The disclosure incorporates the concrete product molding machine and methods disclosed in provisional patent application 60/185,992, filed Mar. 1, 2000, whose priority is claimed for this application.

BACKGROUND OF THE INVENTION

The invention relates particularly to concrete molding machines having molds which are vibrated to densify the concrete mix in the molds. Machines of this character utilize molds which are open at their upper and lower ends and are supported in the machine in a manner to accommodate their vibration. The lower ends of the molds are normally closed by pallets which are supported on a pallet receiver which is movable up to cause the pallet to close the lower end of the mold and to lift it slightly from its mold frame supports and support it for vibration. The pallet receiver frame is provided with resilient members which support the pallet and isolate the vibration. Following charging of a concrete mix to the upper end of the mold and vibration of the mold to compact the wet concrete mix material in the mold, a stripper head is moved downwardly through the mold cavity simultaneously with movement of the pallet receiver downwardly to strip the molded product from the mold. In today's high production machines, the entire cycle may be completed in a matter of seconds.

Molding machinery of this general character is well known and disclosed, for example, in the present assignee's U.S. Pat Nos. 3,545,053; 4,235,580; and 5,952,015, all of which I incorporate herein by reference. Also incorporated herein by reference, is U.S. Pat. No. 4,941,813, which depicts a mold guidance system used on some of the present assignee's machines, as well as another version thereof. Also know is a mold lock system wherein each vertical guide pin on which the mold moves up and down in its vibration can be moved in one lateral direction by a horizontal adjustment screw carried by one of the mold side bars. Bearing pads are provided between the screw and mold side bar and between the frame and mold side bar in lateral alignment with the screw and are referred to respectively as the front mold lock liner and the mold throat liner. To my knowledge, all such pin systems which guide the mold when it is vibrating require manual unfastening and refastening manipulation when molds are to be changed.

During the operation of such machines, a number of different products are normally manufactured on the machine in production runs of various duration, and the molds must be changed to produce such differing concrete products. Molds of this type for producing relatively heavy concrete products, such as concrete blocks, are very large and may weigh in the neighborhood of 4,000 pounds. When a mold is to be changed, present machines require the manual removal of pins and any associated changing mechanisms from the mold to be replaced before it can be moved out of the machine, and then the manual reassembly of such mechanism after a replacement mold is transferred to the machine, before the machine can be placed into operation again.

SUMMARY OF THE INVENTION

The improved machine of the present invention provides powered mechanism for automatically removing the mold guidance pins from operating position to enable the mold to be transferred out of the machine and a replacement mold to then be placed in the machine without impediment.

In the method of practicing the present invention, remotely energized powered mechanism removes mold alignment members downwardly out of the path of the mold from a locked position in which they function as alignment pins for the mold during the vibration cycle and restrain and dampen the lateral components of vibration. Then, after replacement of the mold, the guidance members are automatically replaced with the act of simply energizing the powered member.

One of the prime objects of the present invention is to provide an improved concrete product molding machine which requires much less machine downtime for changeover of the molds.

Another object of the invention is to provide a high production, concrete product molding machine incorporating guidance mechanism which speeds up the product producing process.

A further object of the invention is to provide a durable, heavy duty machine which adequately restrains and dampens lateral components of the vibration.

Still another object of the invention is to provide such a machine with an improved mold guidance mechanism that effectively resists the application of excessive vibratory loads to the machine frame which progressively cause the metal fatigue and failure of parts of the frame and mold, and the consequent costs involved in replacement and machine downtime.

Still another object of the invention is to provide a pin guidance system which automatically locks in position and is not dependent upon human efficiency in the refastening of guidance pins.

Still another object of the invention is to provide an improved machine in which the mold is not as rigidly laterally restrained and mold wear is substantially reduced with the result that the molds will have a longer operational life.

Still another object of the invention is to provide a machine which produces quality concrete blocks and other concrete products in a rapid and efficient manner.

Other objects and advantages of the invention will become apparent with reference to the accompanying drawings and the accompanying descriptive matter.

GENERAL DESCRIPTION OF THE DRAWINGS

The presently preferred embodiment of the invention is disclosed in the following description and in the accompanying drawings, wherein:

FIG. 8 is an elevational view of a guidance pin;

FIG. 12 is an end elevational view thereof;

FIG. 13 is an enlarged perspective plan view of the upper guide mid-block;

FIG. 14 is an end elevational view thereof;

FIG. 15 is a perspective side elevational view of one of the end block members;

DETAILED DESCRIPTION OF THE DRAWINGS

Figure 1:
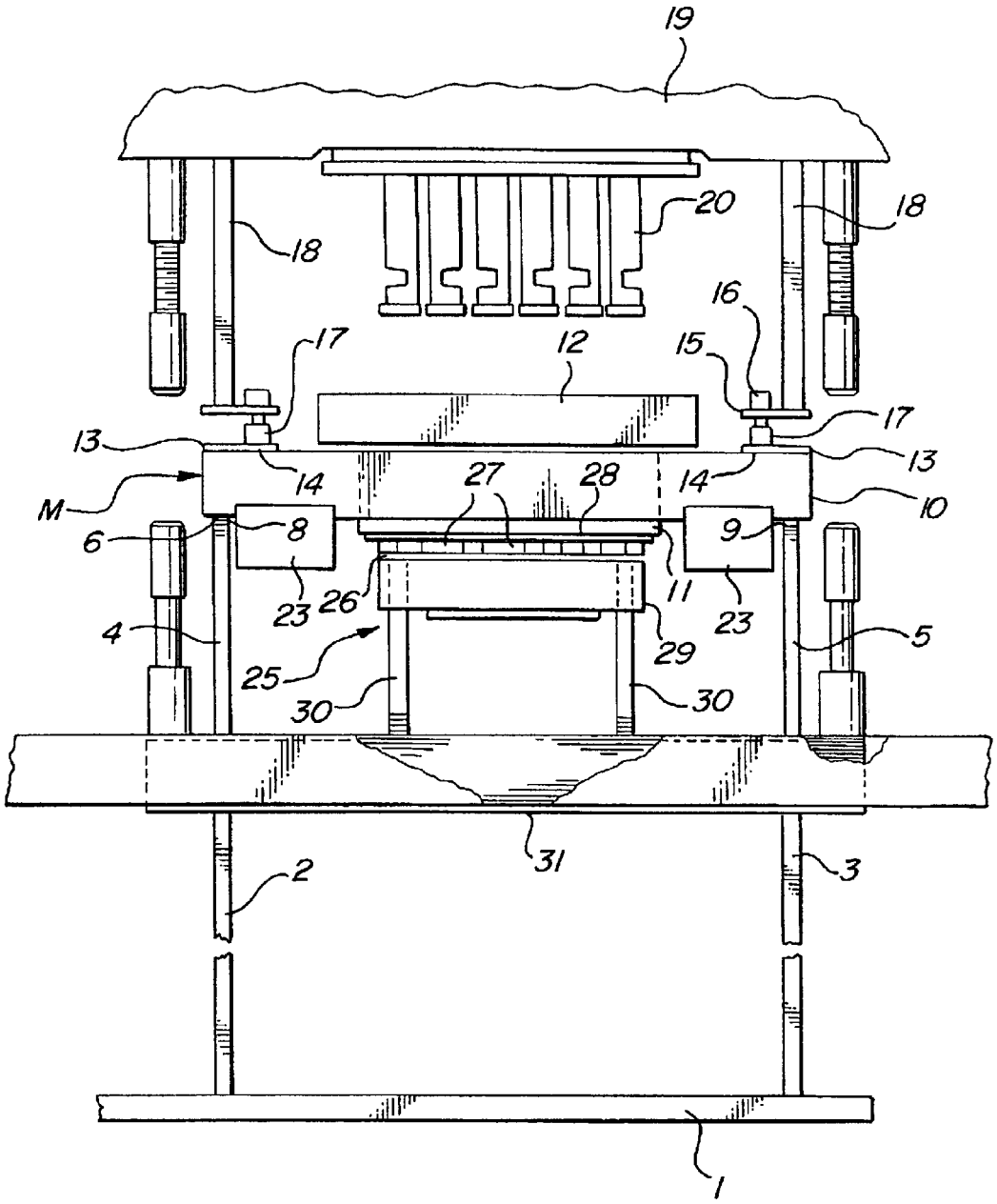
FIG-1 PRIOR ART
FIG. 1 is a schematic front elevational view of a prior art machine with the stripping head in raised position and certain components omitted in the interest of convenience and clarity.
Figure 2:
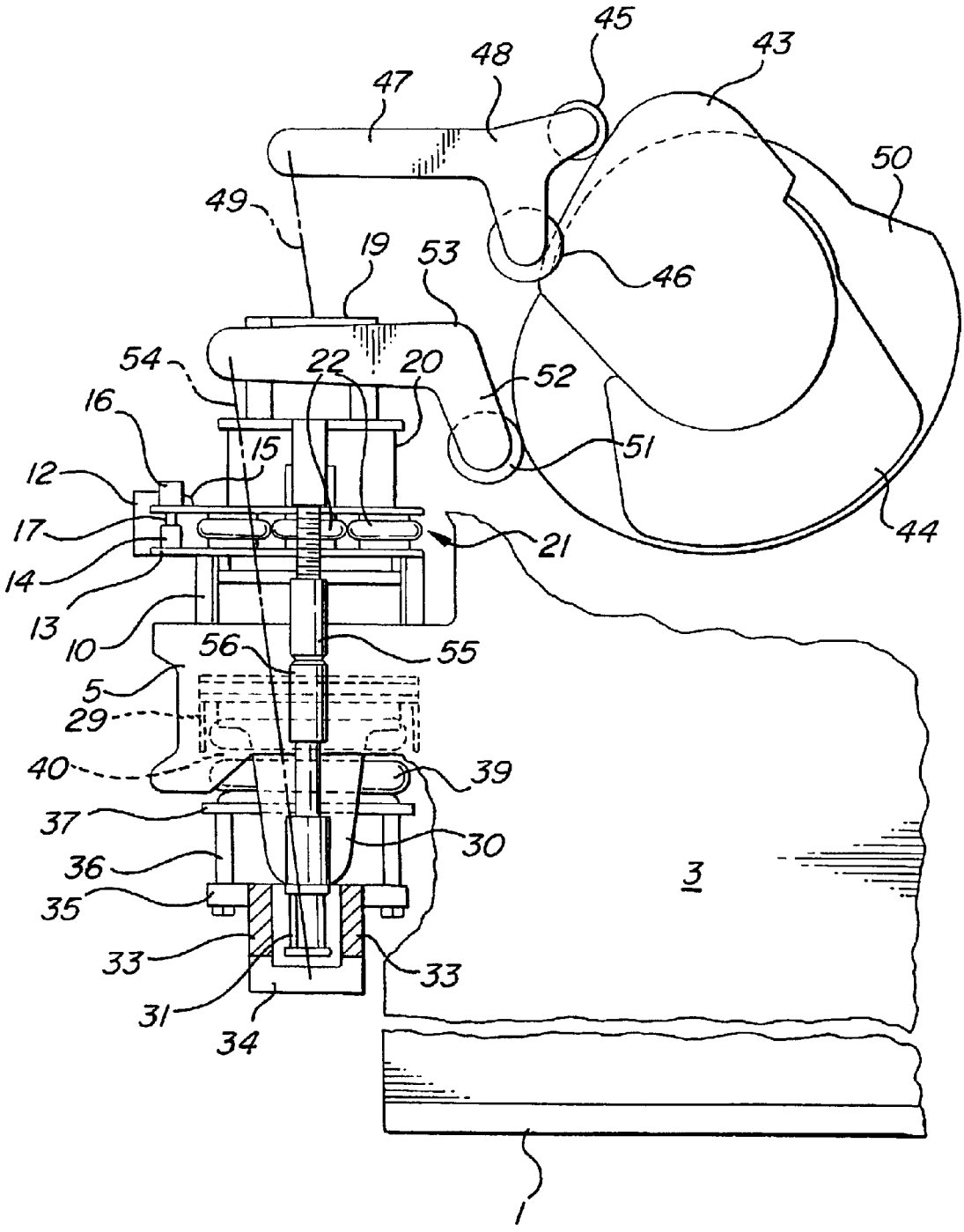
FIG-2 PRIOR ART
FIG. 2 is a similar schematic side elevational view of the prior art machine with certain parts omitted for the sake of convenience and clarity, the view in this case being taken with the stripper head in a lowered position.

Referring now more particularly to the drawings, and in the first instance to FIGS. 1 and 2, for a general disclosure of a prior art concrete product or block making machine of the general character involved in the invention, a base 1 is shown as provided with an upstanding frame including spaced apart frame members 2 and 3. The frame members 2 and 3 shown are the so-called inner frame members which are mounted on outer frame members (not shown) fixed to the base 1, and which have some vertical sliding adjustment thereon. Between their upper and lower ends, the frame members 2 and 3 have forwardly projecting mold supporting arms 4 and 5, respectively, on which the mold, generally designated M, is supported, before the molding operation takes place, on throat surfaces 6 and 7 which have flat horizontal support surfaces 8 and 9.

Spanning the throats 6 and 7 and supported upon the surfaces 8 and 9 when the machine is at rest, is the frame 10 of the mold M, which has an open top and an open bottom, as usual. The interior of the mold M is shaped to correspond to the block or product, or a plurality of the blocks or products, of the kind to be molded, and a shroud 12 is carried by the mold member 10 and surrounds the open top of the mold M.

At opposite ends of the mold frame 10, are secured a pair of fore and aft extending base or lower plates 13. These plates may be references as mold support attachment structure. At the forward end of each plate is fixed a bushing 14. Parallel to, but spaced above each plate 13, is a corresponding upper plate 15 at the forward end of which is fixed a block 16 from which a guide pin 17 extends to be slideably accommodated, and held so as to be substantially laterally restrained, in the companion bushing 14. Upper plates 15 are secured to the lower ends of vertical supports 18 which constitute parts of the machine frame and form slide guides for a stripper frame or frame assembly 19, which is vertically reciprocable in the usual manner thereon.

The vertically moving stripper frame 19, which can be driven vertically by cam structure, supports a stripper head 20, which is of such size and shape as to fit snugly, but slideably, within the mold's cavity or cavities 11. The mold frame 10 normally rests upon the surfaces 8 and 9 of the throats 6 and 7 when the machine is not in operation, but is capable of vertical vibrating movement when pushed upwardly off the surfaces 8 and 9, and is guided in such movement by the guide pins 17. As is conventional, mold frame 10 is fitted with motor driven vibrators, diagrammatically shown at 23, for the purpose of vibrating the mold M and densifying the concrete mix charge which is supplied thereto.

The molding machine includes a pallet support or receiver 25 comprising an upper plate 26 fitted with resilient pads 27, atop which a metal pallet 28 may be supported to form a removable bottom for the mold M. The upper plate 26 has a depending skirt 29, within which is accommodated the upper end of a pair of downwardly tapering support arms 30. The upper ends of the arms 30 are fixed to the plate 26 and the lower ends of the arms are welded to a transverse pallet receiver beam or frame, generally designated 33, which spans the frame members 2 and 3 at the front of the machine. The arms 30 and the beam 33 thus are movable vertically as a unit in a manner and for a purpose presently to be explained. The beam 33 constitutes a motion transmitting means for the pallet receiver plate 26 and its associated structure.

The vertical movements of the stripper frame 19 and the pallet receiver frame 33 may be effected by the cam controlled conventional drive means illustrated diagrammatically in FIG. 2. The drive means for the stripper frame at each end of the machine comprises a pair of motor driven cams 43 and 44, which are engagable and disengagable with a pair of follower rollers 45 and 46, respectively, journalled at one end of a bell crank 47 that is pivoted as at 48 to the machine frame at each end. The opposite end of the crank 47 is pivotally connected, as at 47*a*, by linkage 49 at each end of the machine to the stripper frame 19 to effect upward and downward vertical movements of the latter according to the contours of the cams 43 and 44.

The drive means for the pallet receiver frame 33 at each end of the machine comprises a motor driven cam 50 in engagement with the follower 51, journalled at one end of a bell crank 52 that is pivoted to the machine frame at 53. The opposite end of each crank 52 is pivotally connected at 54*a* to the linkage 54 which connects to the pallet receiver frame 33.

As is conventional, the stripper frame 19 and the pallet receiver frame 33 are provided with confronting pairs of adjustable stops 55 and 56 at each end of the machine operable to limit relative movement of such frames toward one another for the purpose of controlling the height of the block or product formed in the mold 11. After filling of the mold by a feeder device, clamping of the pallet 28 to the bottom of the mold, and the lifting of the mold off the throats by a slight continued upward movement of the pallet receiver 33, the vibrators 23 are operated to vibrate the mold frame, thereby effecting even distribution and compaction of the concrete mix throughout the mold 11.

The stripper head frame 19 is lowered by its drive means and controlled so as to cause the stripper head 20 to enter the mold 11 to the level permitted by the stop members 55 and 56. Thereafter vibration of the mold is discontinued and there is a downward movement of the stripper head and the pallet receiver a distance sufficient to enable the molded block to be pushed through the mold to a level below that of the bottom of the mold. Thereafter, the stripper head frame 19 and the receiver frame 33 are restored upwardly and downwardly, respectively, to initial position by their respective cams.

Figure 3:
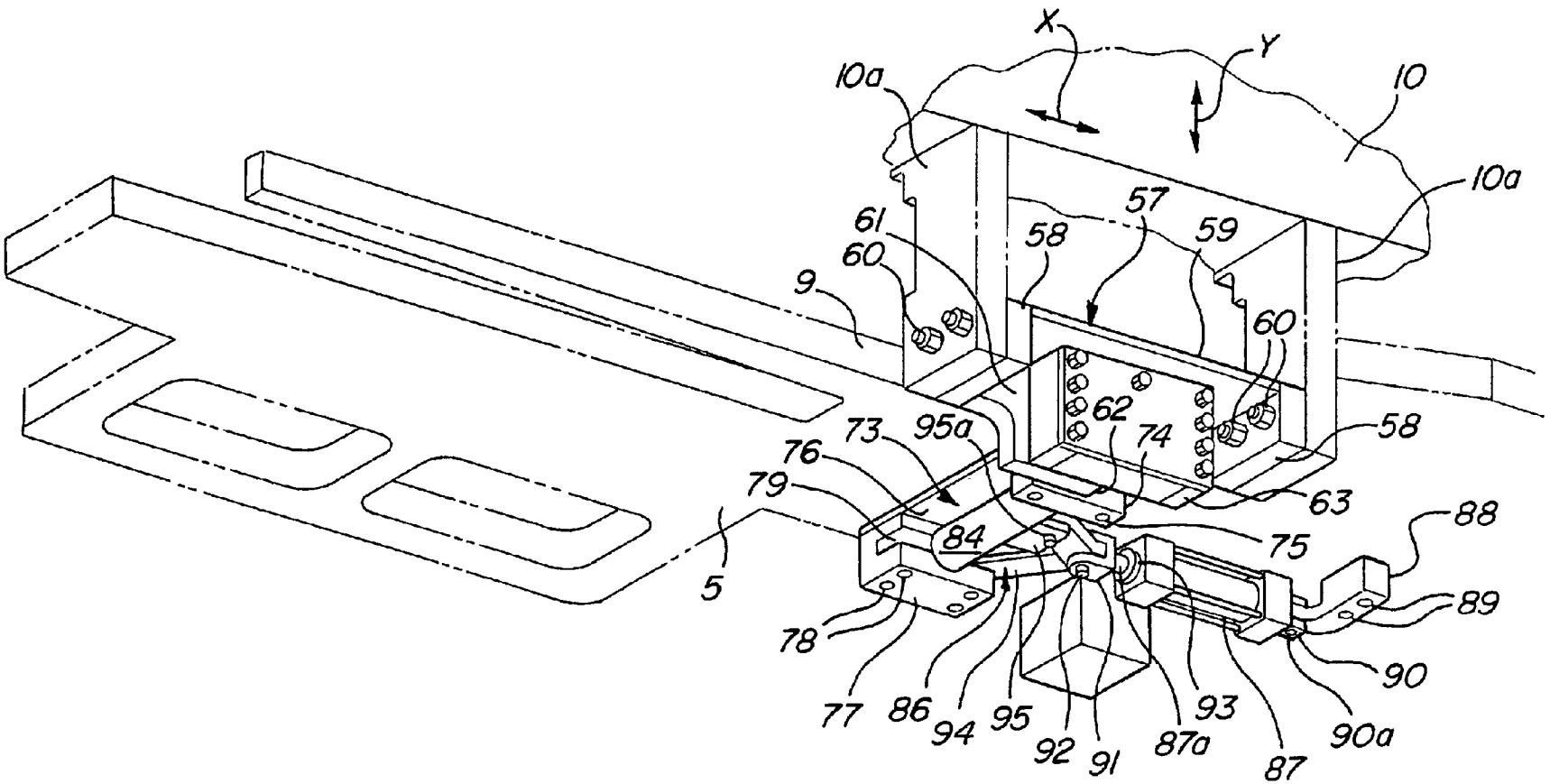
FIG. 3 is a perspective side elevational view illustrating an improved automatically operable guidance pin restraint system constructed in accordance with the invention in position on the machine frame.
Figure 3A:
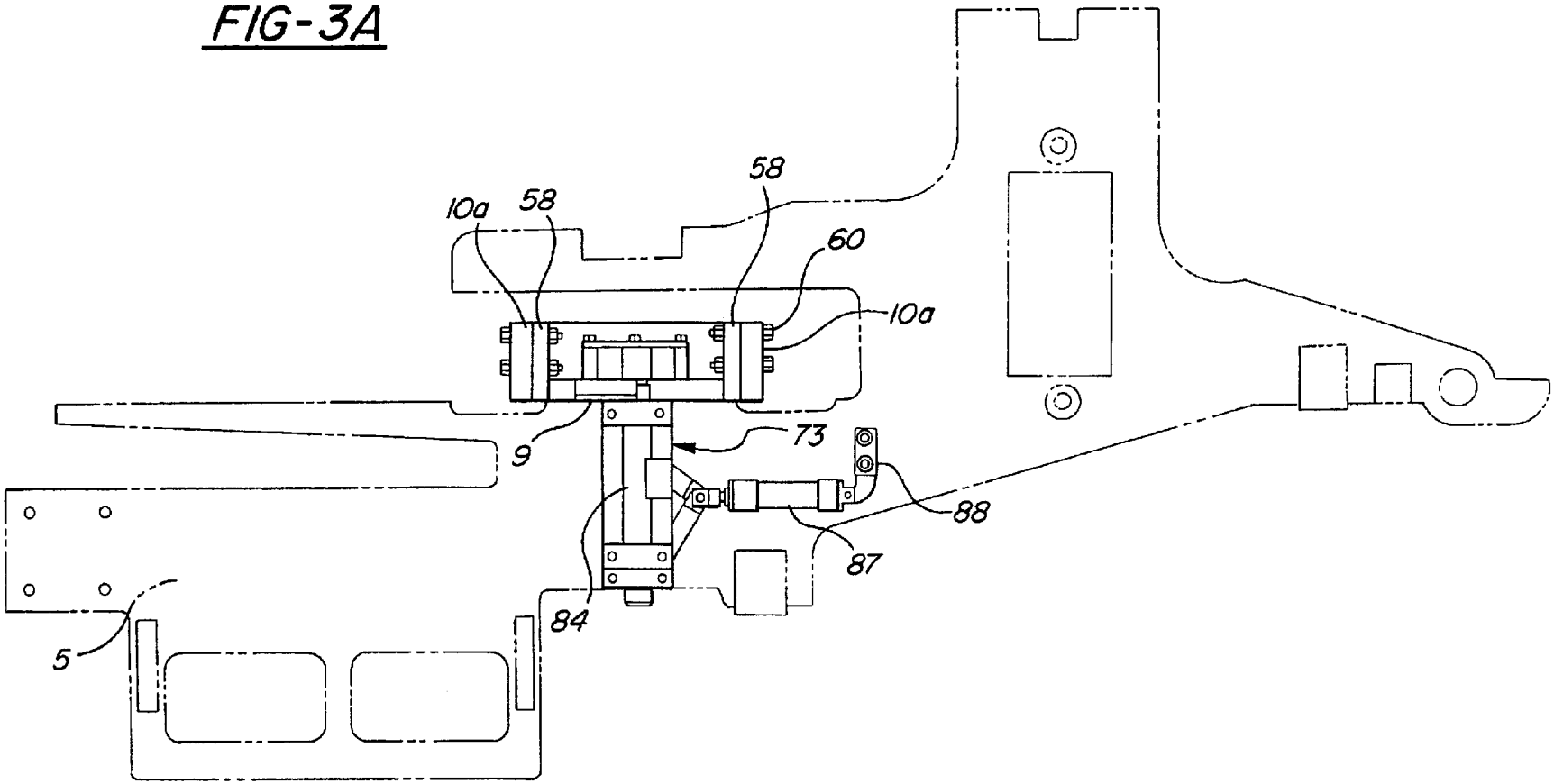
FIG. 3A is a schematic side elevational view thereof.

In FIG. 3, I have shown one of the frame support arms and mold arms fragmentarily and utilized the same numbers as previously in connection with similar parts. Only one of the frame mold support arms and one end of the mold are depicted, but it is to be understood that the other frame mold support arm and opposite end of the mold are mirror identical in construction and so is the mold guidance system. For this reason, it will be unnecessary to repeat the same disclosure for the other end of the machine.

Figure 4:
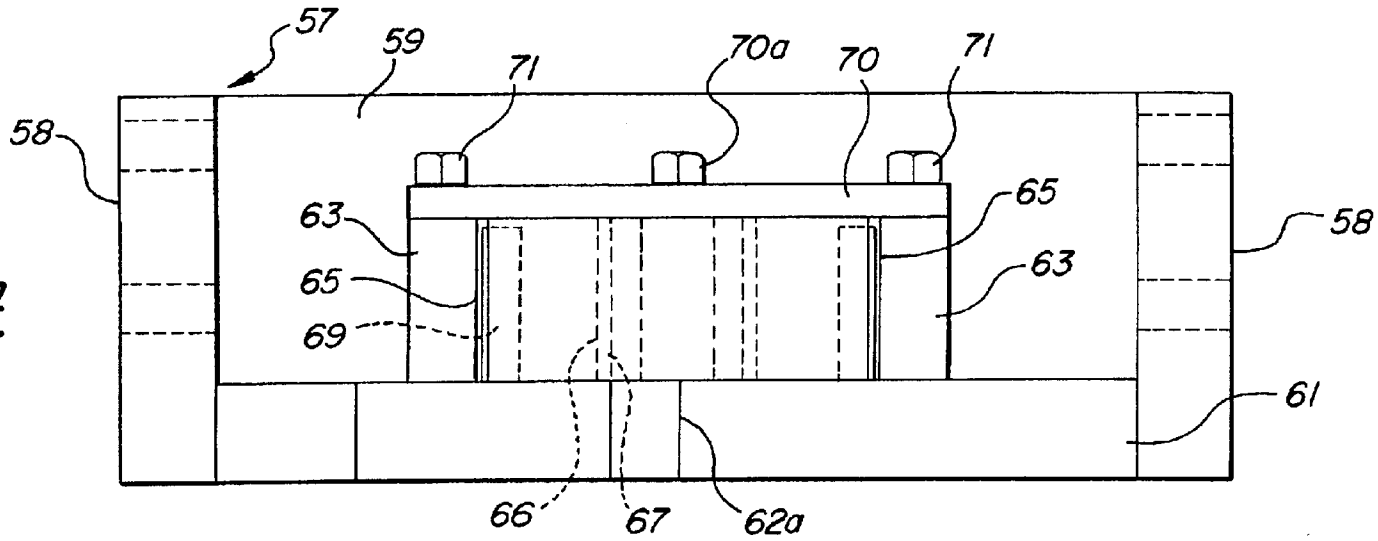
FIG. 4 is an enlarged schematic side elevational view of the spreader assembly utilized in the system at each end of a mold.
Figure 5:
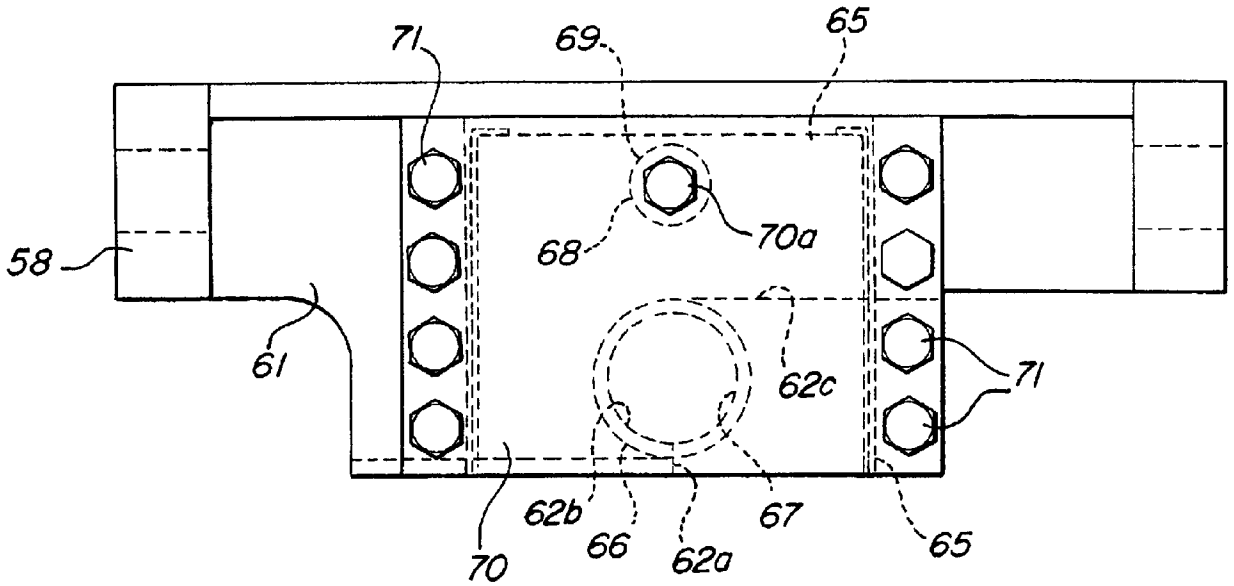
FIG. 5 is a top plan view thereof.

In FIG. 3, the mold 10 is shown as having endwisely projecting support arms 10*a*, which are received upon the mold throat support surface 9 of the frame mold support arm 5. One or more of the arms 10*a* may be referenced as support attachment structure. Provided to connect and rigidify the mold arms 10*a* at each end of the machine, is the spreader assembly (FIGS. 4 and 5), generally designated 57, which includes side bars 58, fixed to a back gusset plate 59, and bolted to the arms 10*a* as at 60. The spreader assembly 57 also includes a bottom plate member 61 (FIG. 4) fixed to the end members 58 and back member 59, which is cut away as at 62.

It is to be noted that the cut-away portion 62 defines a rearwardly extending wall 62*a* (FIG. 5), a curvilinear portion 62*b*, and a rear wall 62*c*. A pair of upright walls 63 are fixed on base plate member 61 on opposite sides of the cutout portion 62*a*. Provided within the enclosure formed by the walls 63, is a solid vibration damping synthetic plastic block 64 which may be provided with side and rear spacers or shims 65 as necessary to locate it precisely. The block 64 preferably will be a polyurethane elastomer block but may be other non-foam members which have a spring rate in the range of 75 1 b/inch to 595 1 b/inch. Block or pad 64 may be referenced as a vibration limiter or a damper. The block 64 has a vertical bore or opening 66 to snugly receive a bushing 67, and a further opening 68 rearward thereof to receive a spacer cylinder 69. A top plate 70 spans the members 63 and is bolted to them as at 71. A bolt 70*a* extends through the spacer 68 to removably anchor the block 64 to base plate 61. It will be noted that the radius of curvilinear portion 62*b* is slightly less than the radius of the outer diameter of the bushing 67 so that the bushing 67 is supported on the base or bottom plate 61. The entire assembly 57 or the supporting bottom plate 61 or the bushing 67 may be characterized as a pin receiving member.

Figure 6:
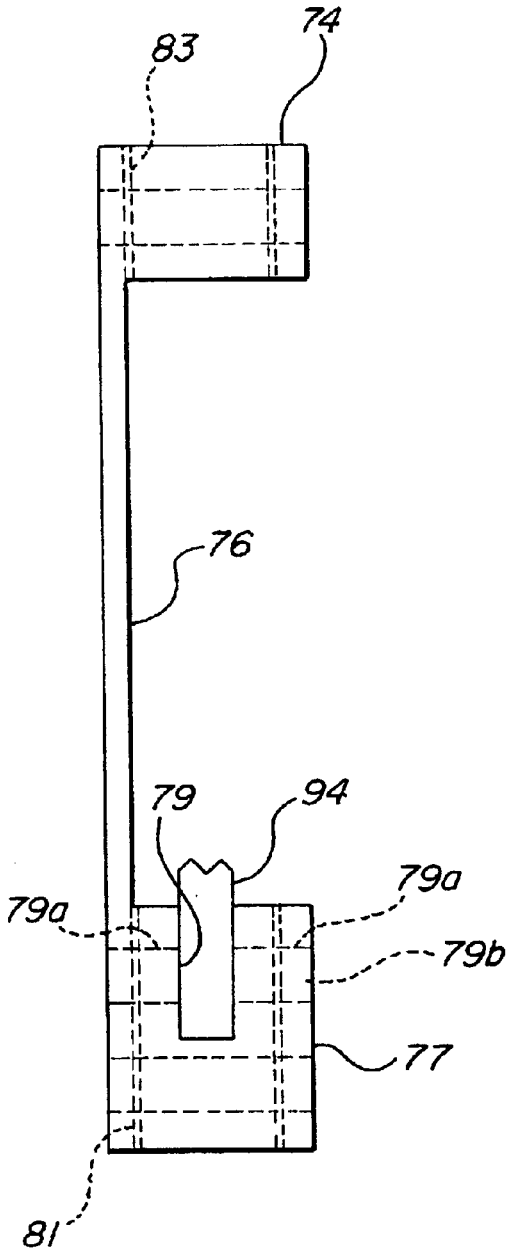
FIG. 6 is an end elevational view of the pin guide mount secured to each end of the frame.
Figure 7:
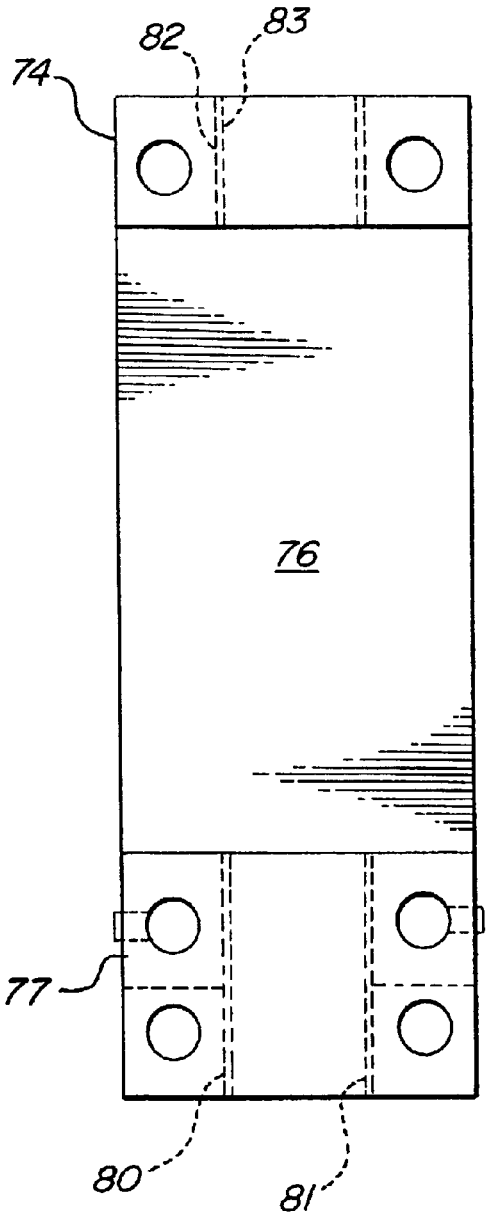
FIG. 7 is a side elevational view thereof.
Figure 9:
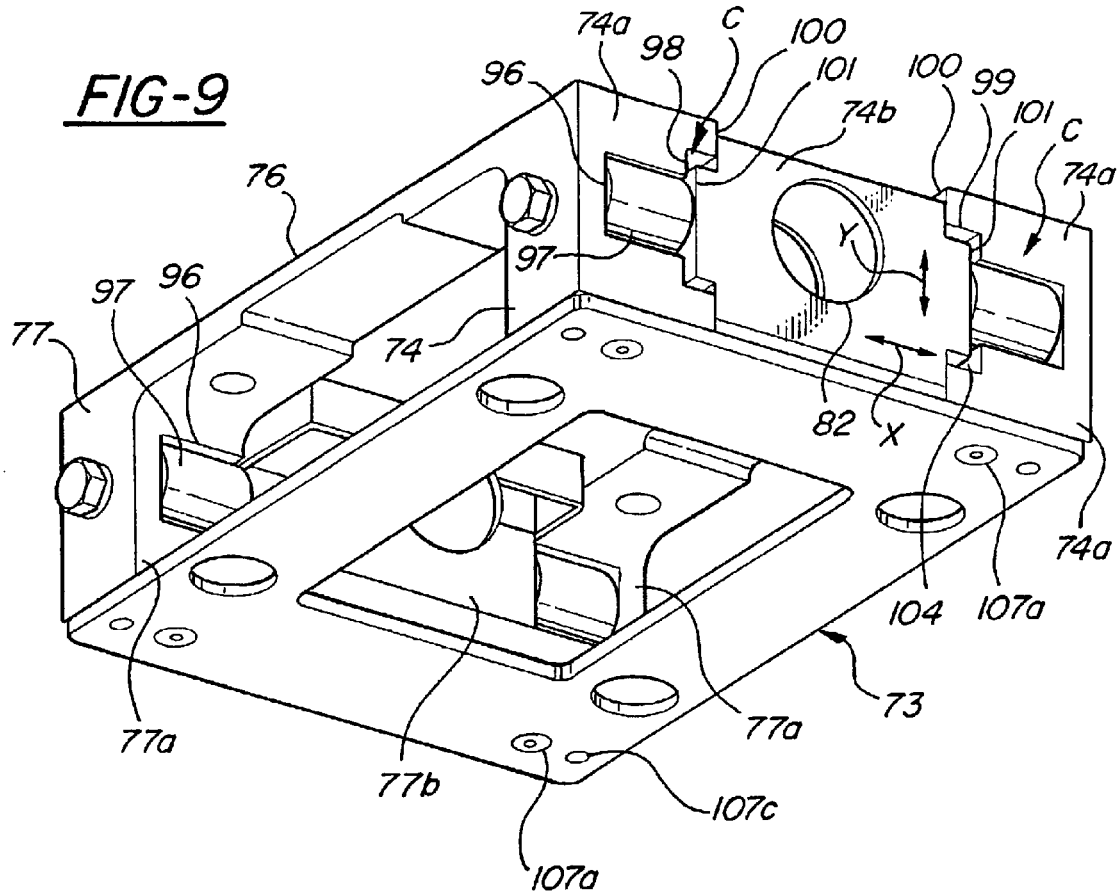
FIG. 9 is a perspective schematic side elevational view of certain elements of a presently preferred embodiment of the guidance pin restraint mechanism, the pin, and its associated toggle mechanism, being indicated in chain lines.

Fixed to the frame member 5 is a guide block (FIGS. 6 and 7), generally designated 73, which includes a head portion 74 bolted to the frame member 5 as at 75, back plate portion 76, and a lower base portion 77, bolted to the frame member 5 as at 78. Base portion 77 has an upwardly facing slot 79 therein. An opening 80 (see FIG. 7) is provided for a bushing 81 fixed in the base portion 77 of the guide bar and an opening 82 is provided in the head portion 74 for fixedly receiving a bushing 83. Support structure for the bushings 81 and 83 may be referenced as a pin carrier assembly.

Slideably received within the bushings 81 and 83 is a pin (see FIG. 8) 84 having a securing slot 85 therein. Pin 84 is moved upwardly and downwardly by a linkage mechanism, generally designated 86, which may be referenced as motor operated mechanism and operated by a powered member in the form of a hydraulic cylinder 87 or other appropriate motor. The cylinder 87 shown is mounted on a cylinder bracket 88 fixed to the frame member 5 by bolts 89, and has an opening (not shown) at its lower end for reception of a pin 90*a*, which pivotally supports the cylinder 87, the cylinder 87 having a clevis lug 90 projecting rearwardly, within which the pin 90*a* is accommodated.

At its front end, the piston 87*a* of cylinder 87 mounts a clevis 91 supporting a pin 92 which pivotally connects an upper toggle link 93 and a lower toggle link 94 for hinged movement. The lower link 94 extends into the slot 86 in mount 73 and pivotally secures to the base member 79 of the mount via pin 79*b* extending through openings 79*a*. Upper link 93 is pivotally secured to a keeper plate 95 as at 95*a*, which is fixed in the slot 85 provided in pin 84 (FIG. 8). The hydraulic cylinder 87 may be operated in the usual manner by depressing push button switches which operate a conventional solenoid operated hydraulic valve to forward or retract piston 87*a*, or in any other suitable manner.

The Operation

In FIG. 3, the piston cylinder 87 is shown in retracted position and it will be understood that the pin 84 is in lowered inoperative retracted position and is not received within the bushing 67 provided in block 64. In the FIG. 3 position, the pin 84 will be in a retracted position slightly below the level of the floor portion 61 of the spreader assembly 57, which secures to the mold arms 10*a*.

For purposes of explanation, it will be assumed that the mold 10 has just been replaced and that the spreader assembly 57 on the new mold is in a position on the throat surfaces of arms 5 and 6 in vertical alignment with the side mount assembly 73 on each of the frame support arms 5 and 6. The hydraulic cylinder 87 on each of the frame arms 5 and 6 will then move each clevis 91 forwardly and function to diverge links 93 and 94 and slide pin 84 upwardly into the bushing 67. When the links 93 and 94 reach a position of vertical alignment, the pin 84 will be fully received within the bushing 67. The forward movement of the piston of cylinder 87, however, continues forwardly or outwardly slightly past the dead center position to effectively lock the pin 84 against withdrawal. When the pin 84 is disposed within the bushing 67 and synthetic plastic block 64, the block 64 serves to dampen lateral motion of the pin 84 and bushing 67 during the vibration of the mold and therefore to dampen the components of lateral vibration which are imposed on the mold. When mold 10 is being vibrated, it, of course, is lifted slightly up off the mold frame throat support surfaces in the usual manner. The pin 84 is of such length as to effectively partly remain in the bushing 81 at the time it is in its upward location.

When a particular production run has been completed and it is desired to replace the mold 10 with another mold, cylinders 87 are operated to retract their piston devises 91 to bring the links 93 and 94 out of "beyond dead center" position and restore the pistons and devises 91 to the position shown in FIG. 3.

Figure 21:
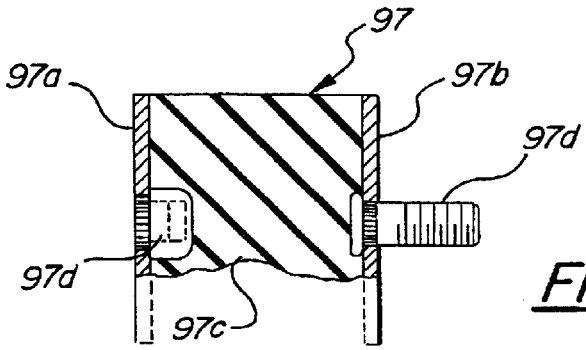
FIG. 21 is an enlarged schematic sectional side elevational view of an elastomeric isolator.

In FIGS. 9–12, a presently preferred, further embodiment of the invention is disclosed in which like parts have been given the same numbers as previously. In this embodiment wherein the differing pin carrier assembly will now be described, the back plate is comprised of two end block portions 73*a* and the head portion 74 comprises a pair of integrated end block portions 74*a*. Between them is an interactive intermediate or mid-block portion 74*b*, which has the opening 82 for receiving the bushing 83. Block or plate 74*b* may be referenced as a slide plate. It will be noted that each of the blocks 74*a*, which may be referenced as fixed elements or clevis shaped plates, is internally recessed as at C to provide an isolator cylinder-accommodating cavity portion 96 for an isolator cylinder or member generally designated 97 which incorporates a polyurethane or other elastomeric material having a spring rate in the range of 75 1 b/inch to 595 1 b/inch, the preferred rate being the latter rate. Since each guide mount on each side of the mold has four isolators, the total spring rate amounts to eight times the individual mount spring rate. It will be seen that members 97 are retained in adjusted position on block portions 74*a* by bolt and washer assemblies 97*a* at each end. Members 97 (see FIG. 21) incorporate rigid inner and outer end circular plates 97*a* and 97*b* between which the flexible resilient material 97*c* is sandwiched and to which it secures. The fasteners 97*a* extend into threaded fittings 97*d* attached to plates 97*b*. The recessing of block portions 74*a* also provides shouldered surfaces 98 and surfaces 99 as shown, extending from end block end surfaces 100. One or more of the isolators 97 may be referenced as a damper or elastomeric pad system.

Figure 11:
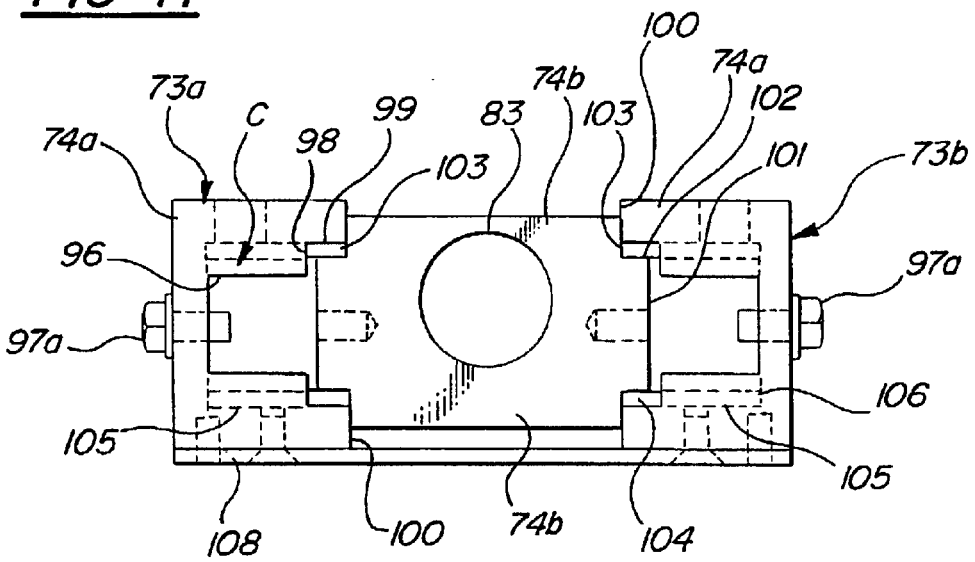
FIG. 11 is a top plan view thereof.

At each end, the middle block portion 74*b*, which mounts bushing 83, includes an end mid-wall portion 101, a side wall portion 102, and recessed end wall portions 103 which abut the end block 74*a* surfaces 100. The surfaces 100 and 103 extend in what may be termed the mold's "right to left" or "y" direction, whereas side surfaces 99 and 102 extend in what may be termed the mold's "fore and aft" or "x" direction. It will be seen that the surfaces 101 of the mid-blocks 74*b* are provided with threaded openings 101*a* for receiving securing screws 97*d* provided on the inner ends 97*b* of the isolators 97 and that there are spaces 104 (FIGS. 9 and 11) between the fore and aft extending side surfaces 99 and 102 of the end blocks 74*a* and intermediate block 74*b* respectively, thus permitting limited movement of the block 74*b* in the denominated right to left direction with vibration. The cavity C for receiving each of the isolator blocks 97 is centrally disposed in the "x" direction and so is axially offset as shown in FIG. 11 with respect to the bushing 83 and includes a circular wall 105 accommodating a cylindrical member 97 with appropriate clearance.

Figure 10:
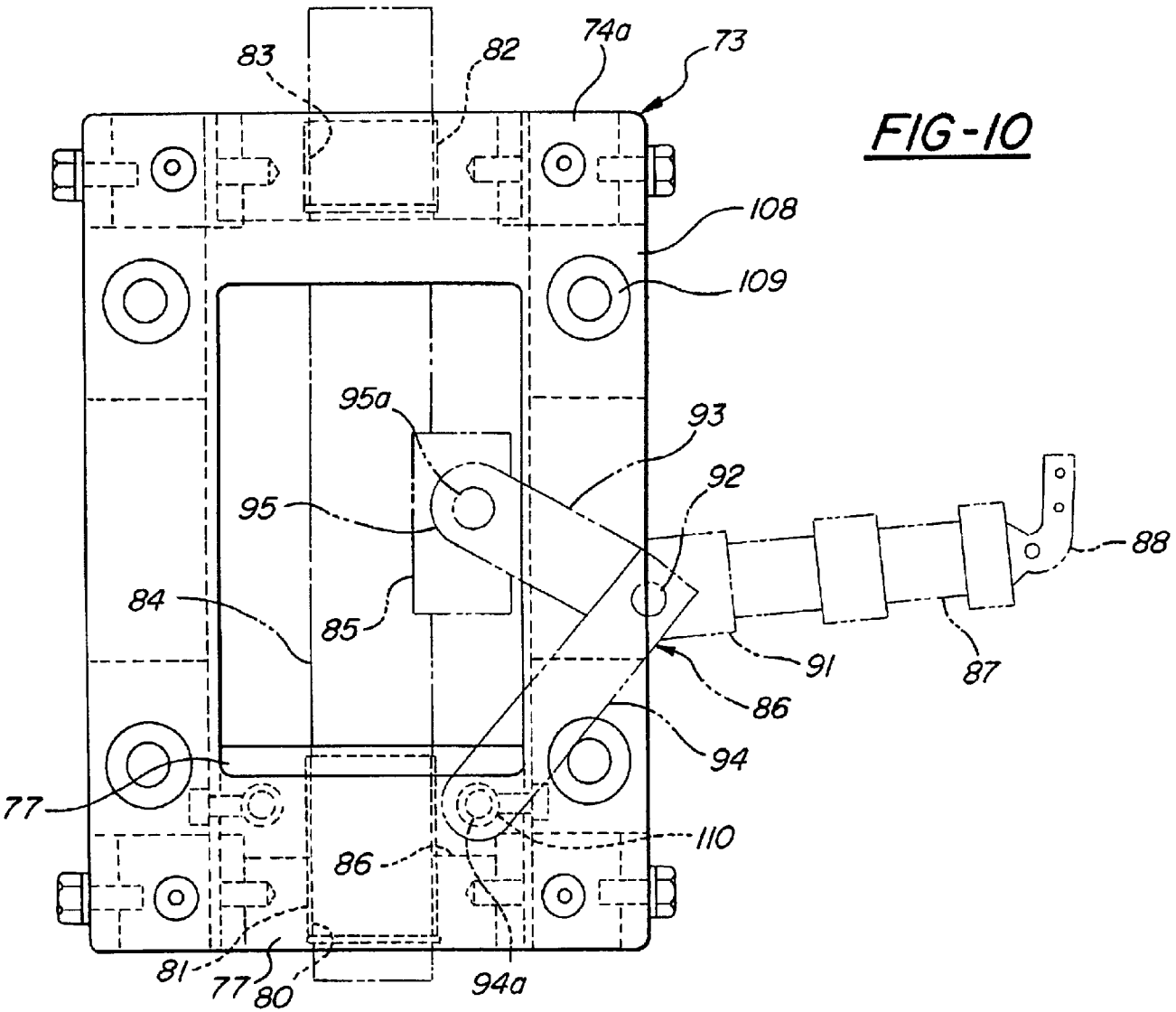
FIG. 10 is an enlarged side elevational view thereof, with powered operating elements being shown in diagrammatic lines.
Figure 16:
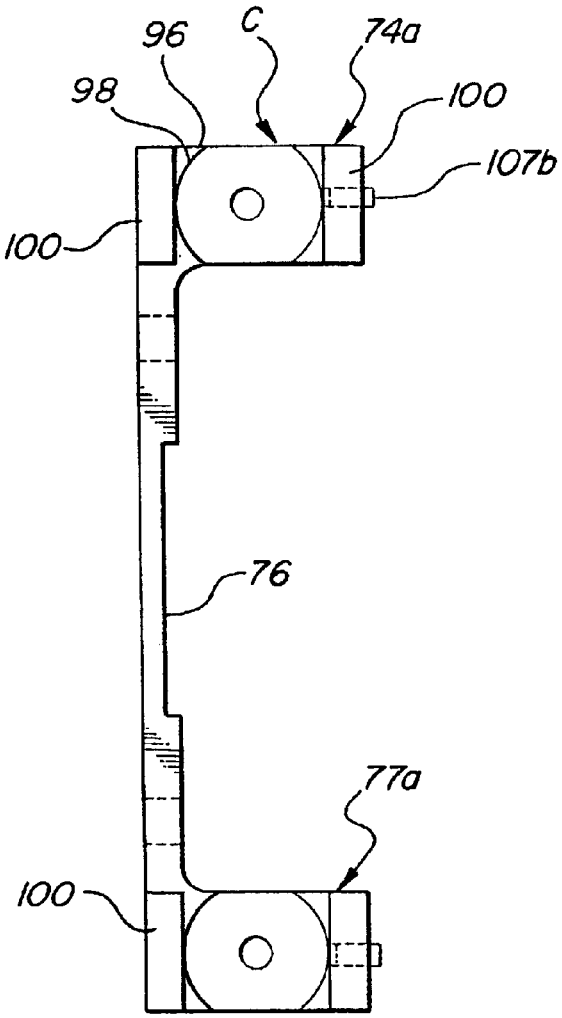
FIG. 16 is a side elevational view thereof.
Figure 17:
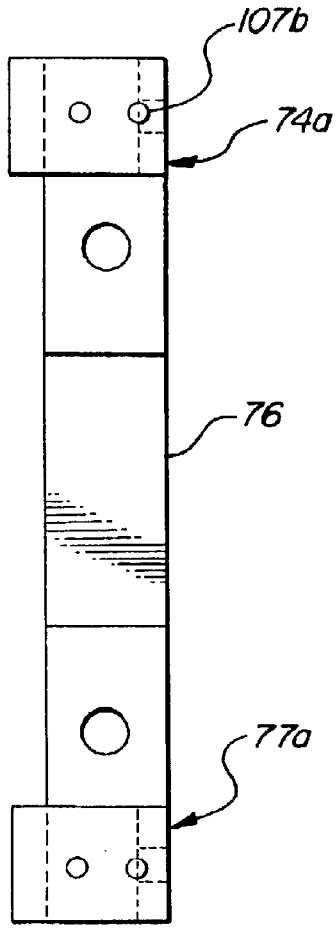
FIG. 17 is an end elevational view thereof.
Figure 18:
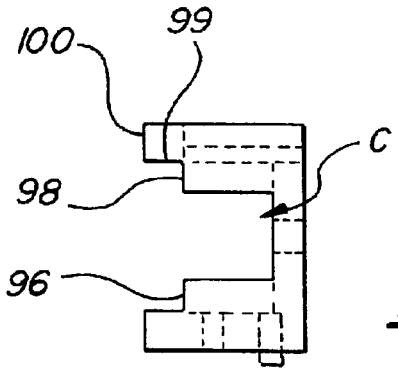
FIG. 18 is a top plan view thereof.
Figure 19:
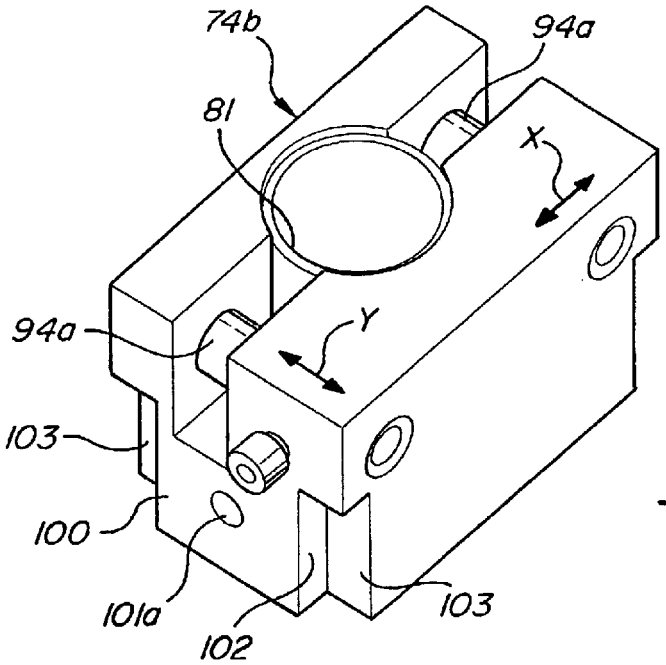
FIG. 19 is an enlarged perspective elevational view of the lower mid guide block only.
Figure 20:
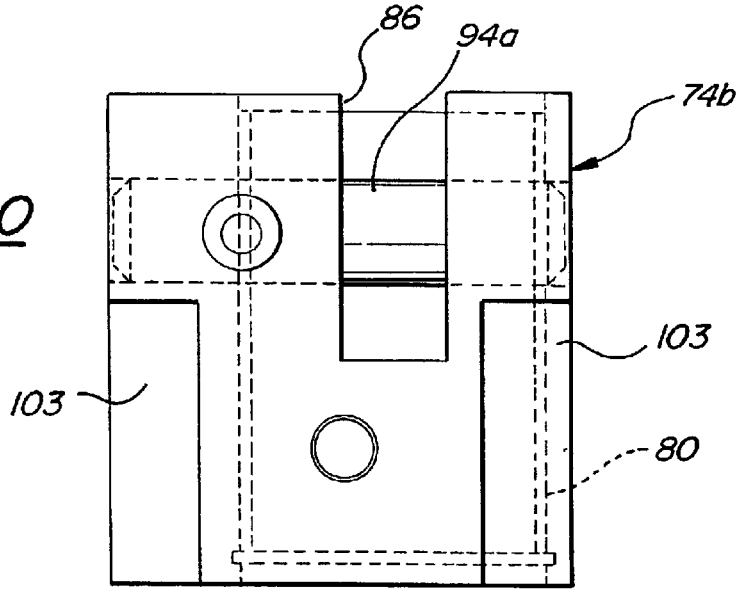
FIG. 20 is an end elevational view thereof.

The structure at the lower end 77 of the guide assembly is similar and includes end blocks 77*a* and an intermediate block 77*b*. The configuration of end blocks 77*a* and mid-block 77*b* is the same as the configuration of end blocks 74*a* and mid-block 74*b* in the sense of provision of the same recess surfaces forming the cavities C, and therefore walls 96 and 100. Likewise walls 103, 102, and 101 are provided on the mid-blocks 74*b*. The isolators 97 are the same and connect to the blocks 77*a* and 77*b* in the same way and the same spaces 104 shown in FIG. 11 are provided to accommodate right to left vibratory movement. Shown in FIG. 10, are the fastener members 110, which extend from the blocks 77 to hold the toggle link pin 94*a*. As FIG. 19 indicates, the particular pin 94*a* in use depends on whether a left or right hand assembly is involved and the disposition of cylinder 87 at one side or the other. A tie plate 107 is provided, secured to end plates 76 by suitable screws extending through openings 107*a*. Locator groove pins 107*b* may be provided on the blocks 74*a* and 77*a* for reception in openings 107*c* in the tie plate 107.

The Operation

In operation, the mold restraint system defined by surfaces 100–103 depicted in FIGS. 9–12 restrain the mold rigidly in the fore to aft direction indicated at "x" in FIG. 3 utilizing the cylindrical isolators 97 to dampen vibratory movement in the right-left direction indicated at "y". The mold is thus semi-rigidly restrained to dampen the left-right load transmitted to the machine components during vibration system engagement and disengagement.

The contact between surfaces 100 and 103 in both the upper and lower mount portions 74 and 77, positively hold the mold rigidly to restrain relative movement in the fore to aft direction "x". The resilient isolators 97, however, are only sufficiently flexible to allow the mold to move slightly in the "y" direction during vibration (i.e., 164th of an inch), yet are sufficiently resilient to return the mold to its initial position after the vibrator system has been engaged/disengaged to allow the mold to maintain alignment with the stripper head.

The operation of the toggle link system with toggle links 93 and 94 and cylinder 87 remains the same, as in the first embodiment described. The difference is that the elastomeric block 64, while it could be used, is no longer required. The bushing 67 does not require it due to the restraint construction in the guide mount assembly or pin carrier assembly depicted in FIGS. 9–12. Block 64 may be a steel block or other structure rigidly supporting the bushing 67. In the first embodiment, the elastomeric block semi-rigidly supports the bushing 67 in the sense that it permits damped movement in any direction, because the bushing 67 is surrounded by the block. In the presently preferred embodiment, fore and aft movement in the "x" direction is positively restrained.

It is to be understood that the disclosed embodiment is representative of a presently preferred form of the invention and that others that accomplish the same function are incorporated herein within the scope of any ultimately allowed patent claims.

What is claimed is:

1. In combination with vibratory concrete product molding machine elements including a frame with wall surface defining generally horizontal mold support surfaces for opposite ends of a mold, a mold having a vertically extending mold cavity including an upper opening portion permitting the supply of a concrete mix to the mold and a lower vertically open portion, a pallet support mounted for lifting movement to dispose a pallet against the lower portion of the mold to close said lower open portion thereof, support attachment structure extending from the mold in a y axis direction to rest on said mold support surfaces prior to being moved upwardly by said pallet support to provide a clearance for vibration of said mold, and a vibrating mechanism for vibrating said mold in a vertical path having lateral x and y axis vibration components, the improvement comprising:

a. a vertical guidance pin receiving member carried by said support attachment structure;

b. a pin carrier assembly mounted on said frame and carrying a vertically disposed guidance pin mounted for vertical reciprocating movement from a position in which its upper end is disposed inoperatively vertically spaced from said pin receiving member and an operative position in which said pin is received by said receiving member and guides the mold in its vibratory travel;

c. a vibration limiter disposed laterally relative to said pin for limiting at least one of said lateral vibration components; and d. motor operated mechanism mounted on said frame having a connecting assembly coupled to said pin for moving said pin vertically.

2. The improvement of claim 1 wherein said connecting assembly comprises a linkage connecting with said pin and movable over center to a position locking said pin in said operative position.

3. The improvement of claim 2 wherein said motor operated mechanism is a double acting cylinder.

4. The improvement of claim 1 wherein said vibration limiter includes an elastomeric damper carried by one of said pin receiving member and pin carrying assembly.

5. The improvement of claim 3 wherein said linkage comprises an upper toggle link connected to said cylinder and pin and a lower toggle link connected between said cylinder and pin carrier assembly disposed in divergent disposition and movable by said cylinder in a diverging path to a position in which said pin is moved to operative position and said links are substantially vertically aligned in center position and beyond to a locked over center position in which said links are reversibly divergent.

6. The improvement of claim 4 wherein said pin receiving member is a spreader assembly mounted between and carried by arms, said spreader assembly having a vertical opening mounting a bushing in which the upper end of said pin is received and a damper pad in lateral operative engagement with said bushing.

7. The improvement of claim 4 wherein said pin carrier assembly includes a laterally extending slide plate having a vertically extending opening for passing and guiding said pin, fixed elements on said pin carrier assembly engaged slidably with said slide plate and substantially preventing movement of said plate in the x axis direction while permitting the plate some limited sliding movement in the y axis direction, and said damper comprises an elastomeric pad system connected between said plate and fixed elements and resiliently deformed upon movement of said plate beyond a rest position.

8. The improvement of claim 7 wherein said slide plate carries a vertical pin receiving bushing having a vertical axis, said plate is shouldered on each end to provide a projecting end central portion and inset side slide surfaces, said pin carrier assembly fixed elements including a clevis shaped fixed mount plate with a recess to receive said end central portion on each end of said slide plate which is of greater dimension than said central portion in the y axis direction to permit said slide plate to slide between said mount plates to a limited degree, said clevis shaped fixed mount plate having end shouldered surfaces in sliding engagement with said inset side surfaces on said slide plate preventing lateral movement of said slide plate in the x axis direction.

9. The improvement of claim 8 wherein said fixed mount plates have damper housing openings relative to said axis of the pin receiving openings leading from said recesses, and said damper system comprises a pair of damper cylinders confined in each of said damper housing openings and connected to said slide plate centrally.

10. The improvement of claim 7 wherein vertically spaced slide plates are provided at the upper and lower ends of said pin carrier assembly.

11. The improvement of claim 9 wherein each damper cylinder has a spring rate in the range 75 pounds per inch to 595 pounds per inch.

12. A method of damping vibration in a vibratory concrete product molding machine incorporating a frame with wall surface defining mold support surfaces for opposite ends of a mold, a mold having a vertically extending mold cavity including an upper opening portion permitting the supply of a concrete mix to the mold and a lower vertically open portion, a pallet receiver support mounted for lifting movement to dispose a pallet against the lower portion of the mold to close the mold at the bottom, support attachment structure extending from the mold to rest on the mold support surfaces prior to being moved upwardly by said pallet support to provide a clearance for vibration of the mold and vibrating mechanism for vibrating the mold in a vertical path having lateral x and y axis vibration components, the improvement comprising:

a. providing a vertical guidance pin receiver member in the support attachment structure;

b. providing a pin carrier assembly mounted on the frame and carrying a vertically disposed guidance pin mounted for vertical reciprocating movement from a position in which its upper end is disposed inoperatively vertically spaced from the pin receiving member to an operative position in which the pin receiving member guides the mold in its vibratory path;

c. providing motor operated mechanism mounted on said frame having connecting assembly coupled to said pin for moving said pin vertically to operative position; and d. providing a vibration limiter disposed laterally relative to said guidance pin for limiting at least one of said lateral vibration components.

13. The method of claim 12 comprising providing said connecting assembly with a linkage connecting with said pin and movable over center to a position locking said pin in said operative position.

14. The method of claim 12 comprising providing an elastomeric damper in said vibration limiter carried by one of said pin receiving member and pin carrying assembly.

15. The method of claim 12 comprising providing a double acting cylinder for operating said motor operated mechanism and providing said linkage as an upper toggle link connected to said cylinder and a lower toggle link connected between said cylinder and pin carrier assembly disposed in divergent disposition and movable by said cylinder in a divergent path to a position in which said pin is moved to operative position and said links are substantially vertically aligned in center position and beyond to a locked over center position in which said links are reversibly divergent.

16. The method of claim 12 comprising providing said vibration limiter in a pin carrier assembly which includes a laterally extending slide plate having a vertically extending opening for passing and guiding said pin, providing fixed elements on the pin carrier assembly engaged slidably with said slide plate and limiting movement of said slide plate in the x axis direction while permitting the plate some delimited sliding movement in the y axis direction, and providing said damper as an elastomeric pad system connected between said slide plate and fixed elements and resiliently deformed upon movement of said plate beyond a rest position.

17. In combination with a vibratory concrete product molding machine including a frame with wall surfaces defining generally horizontal mold support surfaces for opposite ends of a mold, a mold having a vertically extending mold cavity including an upper opening portion permitting the supply of a concrete mix to the mold, a pallet receiver support mounted for lifting movement to dispose a pallet against the lower portion of the mold to close said lower open portion thereof, support attachment structure extending from the mold in a y axis direction to rest on said mold support surfaces prior to said mold being moved upwardly by said pallet receiver support to provide a vertical clearance for vibration of said mold, and a vibrating mechanism for vibrating said mold in a vertical path having lateral x any y axis vibration components, the improvement comprising:

a. a vertical guidance pin receiving member carried by said support attachment structure;

b. a pin carrier assembly mounted on said frame and carrying a vertically disposed guidance pin mounted for vertical reciprocating movement from a position in which its upper end is disposed inoperatively vertically spaced from said pin receiving member and an operative position in which said pin receiving member receives said pin and guides the mold in its vibratory travel;

c. a vibration limiter on said pin carrier assembly and including a laterally extending slide plate having a vertically extending opening for passing and guiding said pin;

d. fixed elements on said pin carrier assembly slidably engaged with said slide plate and preventing movement of said slide plate in the x axis direction while permitting the slide plate some limited sliding movement in the y axis direction;

e. said limiter further comprising an elastomeric pad system connected between said slide plate and fixed elements which is resiliently deformed upon movement of said slide plate beyond its rest position.

18. The improvement of claim 17 wherein said slide plate carries a vertical pin receiving bushing having a vertical axis, said plate is shouldered on each end to provide a projecting end central portion and inset side slide surfaces, said pin carrier assembly fixed elements comprising mount plates with a recess to receive said end central portions of said slide plate which is of greater dimension than said central portion in the y direction to permit said slide plate to slide to a limited degree, said fixed mount plates having end shouldered surfaces in sliding engagement with said inset side surfaces on said slide plate preventing lateral movement of said slide plate in the x axis direction, said fixed mount plates having damper housing openings lateral to said axis of the pin receiving openings leading from said recesses, and said damper system comprising damper cylinders confined in each of said damper housing openings centrally connected to said slide plate.

19. A method of constructing a vibratory concrete product molding machine including a frame with wall surface defining generally horizontal mold support surfaces for opposite ends of a mold, a mold having a vertically extending mold cavity including an upper opening portion permitting the supply of a concrete mix to the mold and a lower vertically open portion, a pallet support mounted for lifting movement to dispose a pallet against the lower portion of the mold to close said lower open portion thereof, support attachment structure extending from the mold in a y axis direction to rest on said mold support surfaces prior to said mold being moved upwardly by said pallet support to provide a vertical clearance for vibration of said mold, and a vibrating mechanism for vibrating said mold in a vertical path having lateral x and y axis vibration components, the improvement comprising:

a. providing a vertical guidance pin receiving bushing carried by said support attachment structure;

b. providing a pin carrier assembly on said frame carrying a vertically disposed guidance pin mounted for vertical reciprocating movement from a position in which its upper end is disposed inoperatively vertically spaced from said pin receiving member to an operative position in which said pin receiving member receives said pin and guides the mold in its vibratory travel;

c. providing a laterally extending slide plate having a vertically extending opening for passing and guiding said pin on said pin carrier assembly, providing fixed elements on said pin carrier assembly engaged slidably with said slide plate and limiting movement of said plate in the x axis direction while permitting the slide plate some limited sliding movement in the y axis direction, and further providing an elastomeric damping pad system connected between said slide plate and fixed elements which resiliently deforms upon movement of said slide plate beyond a rest position.

20. The method of claim 19 comprising providing said slide plate with a vertical pin receiving bushing having a vertical axis, shouldering said slide plate on each end to provide a projecting end portion bounded by inset side slide surfaces, providing fixed elements on said pin carrier assembly comprising mount plates each having a recess to receive said projecting portion of said slide plate which is of greater dimension than said projecting portion in the y axis direction to permit said slide plate to slide thereon to a limited degree, shouldering said fixed mount plates to provide shoulder surfaces in sliding engagement with said inset side surfaces on said slide plate to prevent lateral movement of said slide plate in the x axis direction, and providing said fixed mount plates with damper cylinder housings lateral to said axis of said pin receiving opening and damper cylinders confined in each of said damper housings.

* * * * *